US008879762B2

(12) United States Patent
Choi

(10) Patent No.: US 8,879,762 B2
(45) Date of Patent: Nov. 4, 2014

(54) METHOD AND APPARATUS TO EVALUATE QUALITY OF AUDIO SIGNAL

(75) Inventor: In-Yong Choi, Uiwang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 702 days.

(21) Appl. No.: 12/695,252

(22) Filed: Jan. 28, 2010

(65) Prior Publication Data

US 2010/0189290 A1 Jul. 29, 2010

(30) Foreign Application Priority Data

Jan. 29, 2009 (KR) ..... 10-2009-0006999

(51) Int. Cl.
*H04R 5/02* (2006.01)
*H04R 5/00* (2006.01)
*H04S 7/00* (2006.01)

(52) U.S. Cl.
CPC ..... *H04S 7/00* (2013.01)
USPC ..... 381/309; 381/20; 381/56; 381/57; 381/110; 381/300; 381/303; 381/301; 381/310; 700/94; 704/226; 704/205; 704/206; 704/207; 704/208; 704/209; 704/210; 704/211; 704/213; 704/214

(58) Field of Classification Search
USPC ..... 381/56, 57, 110, 300, 303, 301, 309, 381/310, 20; 700/94; 704/226, 205–219, 704/200, 201.1, 216
See application file for complete search history.

(56) References Cited

U.S. PATENT DOCUMENTS 5,617,478 A * 4/1997 Tagami et al. ..... 381/56
6,271,771 B1 8/2001 Seitzer et al.
6,794,567 B2 * 9/2004 Hughes et al. ..... 84/609
6,804,566 B1 * 10/2004 Colomes et al. ..... 700/94
6,823,302 B1 * 11/2004 Atkinson et al. ..... 704/216
7,024,259 B1 * 4/2006 Sporer et al. ..... 700/94
7,065,217 B2 * 6/2006 Gierl et al. ..... 381/10
7,146,313 B2 * 12/2006 Chen et al. ..... 704/230
7,194,093 B1 * 3/2007 Thiede ..... 381/58
7,664,231 B2 * 2/2010 Schmidmer et al. ..... 379/1.02
2005/0244015 A1 * 11/2005 Sung ..... 381/58
2006/0177003 A1 8/2006 Keyhl et al.
2008/0249769 A1 * 10/2008 Baumgarte ..... 704/227

OTHER PUBLICATIONS

In Yong Choi et al; Prediction of Perceived Auditory Quality in Multichannel Audio Compression Coding Systems, AES, May 2007.*
Recommendation ITU-R BS.1387-1, 1998-2001.*
George et al; Initial developments of an objective method for the prediction of basic audio quality for surround audio recordings, AES, May 2006.*
Zielinski et al; Development and Initial Validation of a Multichannel Audio Quality Expert System, AES,2005.*
List of Corrections of The ITU-R Recommendation BS.1387 publication, entitled "Method for Objective Measurements of Perceived Audio Quality", was published in 1998.

* cited by examiner

*Primary Examiner* — Davetta W Goins
*Assistant Examiner* — Kuassi Ganmavo
(74) *Attorney, Agent, or Firm* — Stanzione & Kim, LLP

(57) ABSTRACT

A method and apparatus to evaluate a quality of an audio signal, in which the number of effective channels is determined for each of a reference signal of a current frame and a test signal indicative of the reference signal that has passed through an audio codec, and an audio quality evaluation score of the current frame is calculated by evaluating an audio quality of the current frame based on the determined number of effective channels for each of the reference signal and the test signal by means of a predetermined evaluator.

17 Claims, 7 Drawing Sheets

METHOD AND APPARATUS TO EVALUATE QUALITY OF AUDIO SIGNAL

CROSS-REFERENCE TO RELATED APPLICATIONS

This application claims the benefit under 35 U.S.C. §119 (a) of a Korean Patent Application filed in the Korean Intellectual Property Office on Jan. 29, 2009 and assigned Serial No. 10-2009-0006999, the entire disclosure of which is hereby incorporated by reference in its entirety.

BACKGROUND

1. Field of the Invention

The present general inventive concept relates generally to a method and apparatus to evaluate a quality of an audio signal, and more particularly, to a method and apparatus to evaluate a quality of an audio signal according to a number of channels of the audio signal.

2. Description of the Related Art

Generally, an audio codec refers to a device to code and decode various audio signals, including a voice signal. A wide variety of multi-channel codecs have been recently developed. For example, a multi-channel codec, such as a 5.1-channel audio codec, is mainly used to code and decode audio signals in multimedia contents such as movies, and supports additional audio channels to give surround effects using rear speakers. Meanwhile, along with the increase in broadcast or Internet broadcast services over a wireless network, such as Internet Protocol TV (IPTV) and Digital Multimedia Broadcasting (DMB), there is an increasing demand for various voice codecs, and it is important to select an appropriate voice codec according to the purpose of the service.

In order to select an appropriate voice codec according to the type of the service, it is necessary to evaluate a quality of an audio signal that is output through a voice codec. For the audio quality evaluation, listening evaluation may be performed in which a plurality of listeners directly listen to audio signals. Since the listening evaluation takes a lot of time and cost, a method of evaluating an audio quality using an audio quality evaluation apparatus is generally used. For reference, International Telecommunication Union (ITU)-R has issued ITU-R Recommendation BS.1387, which is a recommendation on an audio quality evaluation method for audio codecs.

An audio signal may be roughly classified into a mono signal, a stereo signal and a multi-channel signal according to the number of channels included in the audio signal. A typical example of the multi-channel signal includes a 5.1-channel signal.

Factors to be considered in audio quality evaluation may vary according to the number of channels of an audio signal. For example, the level of noises contained in an audio signal, the difference in tone, and the sound rolling in the time domain are factors that may be involved in audio quality evaluation regardless of the type of the audio signal. On the other hand, spatial factors such as the sound stage, the position of the sound, and the width of the sound source are not considered in evaluation of the mono signal. However, the spatial factors should be considered in evaluation of the stereo signal, and during evaluation of the multi-channel signal, the spatial factors should be considered more compared to during the evaluation of the stereo signal. That is, while factors for evaluating auditory qualities to give the surround effects are not needed in audio quality evalukion for an audio codec supporting only the mono-channel signal, the factors for evaluating auditory qualities to give the surround effects are very important in audio quality evaluation for a multi-channel audio codec. Undesirably, however, the conventional audio quality evaluation apparatus should be changed in structure according to the type of the audio signal.

In addition, the conventional audio quality evaluation apparatus uses a similar scheme to the evaluation scheme for the stereo signal in evaluating the multi-channel signal. Therefore, in case of the multi-channel signal, a correlation between the evaluation result obtained by the audio quality evaluation apparatus and the listening evaluation actually evaluated by the people may fall undesirably, which means the poor performance of the audio quality evaluation apparatus.

Because the factors to be considered during audio quality evaluation vary according to the number of channels of the audio signal, it is very important to select an appropriate evaluation scheme depending on the number of channels of an audio signal in audio quality evaluation. For this, however, a user must inconveniently find out the number of channels of the audio signal before the audio quality evaluation. Therefore, there is a need to automatically check the number of channels of an audio signal during audio quality evaluation.

Furthermore, listeners may listen to audio signals with a headphone, or with a speaker. Therefore, a listening environment of the listeners should also be considered during audio quality evaluation of the audio signals. That is, a way of processing an output signal of an audio codec for audio quality evaluation of an audio signal should be changed according to the listening environment for the audio signal. However, the conventional audio quality evaluation apparatus has a poor audio quality evaluation performance because it does not consider these factors.

SUMMARY

The present general inventive concept provides an audio quality evaluation method and apparatus to optimally evaluate an audio quality according to a type of an audio signal.

The present general inventive concept also provides a method and apparatus to determine the number of channels of an audio signal and to determine an optimal audio quality evaluator according to the determined number of channels.

The present general inventive concept also provides a method and apparatus to determine an optimal audio quality evaluator according to a listening environment for an audio signal.

Additional aspects and utilities of the present general inventive concept will be set forth in part in the description which follows and, in part, will be obvious from the description, or may be learned by practice of the general inventive concept.

Embodiments of the present general inventive concept provide a method of evaluating a quality of an audio signal, in which the number of effective channels is determined for each of a reference signal of a current frame and a test signal indicative of the reference signal that has passed through an audio codec, and an audio quality evaluation score of the current frame is calculated by evaluating an audio quality of the current frame based on the determined number of effective channels for each of the reference signal and the test signal by means of a predetermined evaluator.

Embodiments of the present general inventive concept also provide an apparatus to evaluate a quality of an audio signal, in which an effective channel checker determines the number of effective channels for each of a reference signal of a current frame and a test signal indicative of the reference signal that has passed through an audio codec, an evaluator selector selects an audio quality evaluator for evaluating an audio quality of the current frame based on the determined number of effective channels for each of the reference signal and the test signal, and an audio quality evaluation unit calculates an audio quality evaluation score of the current frame by evaluating an audio quality of the current frame.

Embodiments of the present general inventive concept also provide a method of evaluating a quality of an audio signal, including dividing a reference signal and a test signal of an input audio signal into frames of a predetermined time period; determining the number of effective channels of the input audio signal based on the frames of the reference signal and a test signal; and calculating a total audio quality evaluation score of all frames.

The determining the number of effective channels can include determining which channels have an energy level greater than a specific level in a frame.

The calculating a total audio quality evaluation score of all frames can include calculating individual scores of the time frames, and setting difference frame evaluation schemes according to system features.

Embodiments of the present general inventive concept also provide an audio signal quality determination apparatus, including: a frame divider to divide a test signal and a reference signal of an input audio signal into frame of a predetermined time period; an effective channel checking device to check effective channels of an input audio signal including a test signal and a reference signal divided into frames of a predetermined time period and to select an appropriate evaluator to evaluate the divided input signal based on the determination of the effective channels; and an audio quality evaluation unit to evaluate a quality of the audio signal received from the effective channel checking device according to the signal type based in the effective channels.

The audio quality evaluation unit can include a mono evaluator, a headphone-stereo evaluator, a speaker-stereo evaluator, an UP-mix evaluator and a multi-channel evaluator.

The apparatus can also include a score calculator to calculate a total score of an audio quality for an entire time through a predetermined operation using an audio quality evaluation score in a current frame and an audio quality evaluation score of up to a previous frame, which are based on evaluation results by the audio quality evaluation unit.

BRIEF DESCRIPTION OF THE DRAWINGS

The above and other features and utilities of exemplary embodiments of the present general inventive concept will be more apparent from the following description taken in conjunction with the accompanying drawings, in which.

DETAILED DESCRIPTION OF THE EMBODIMENTS

Figure 1:
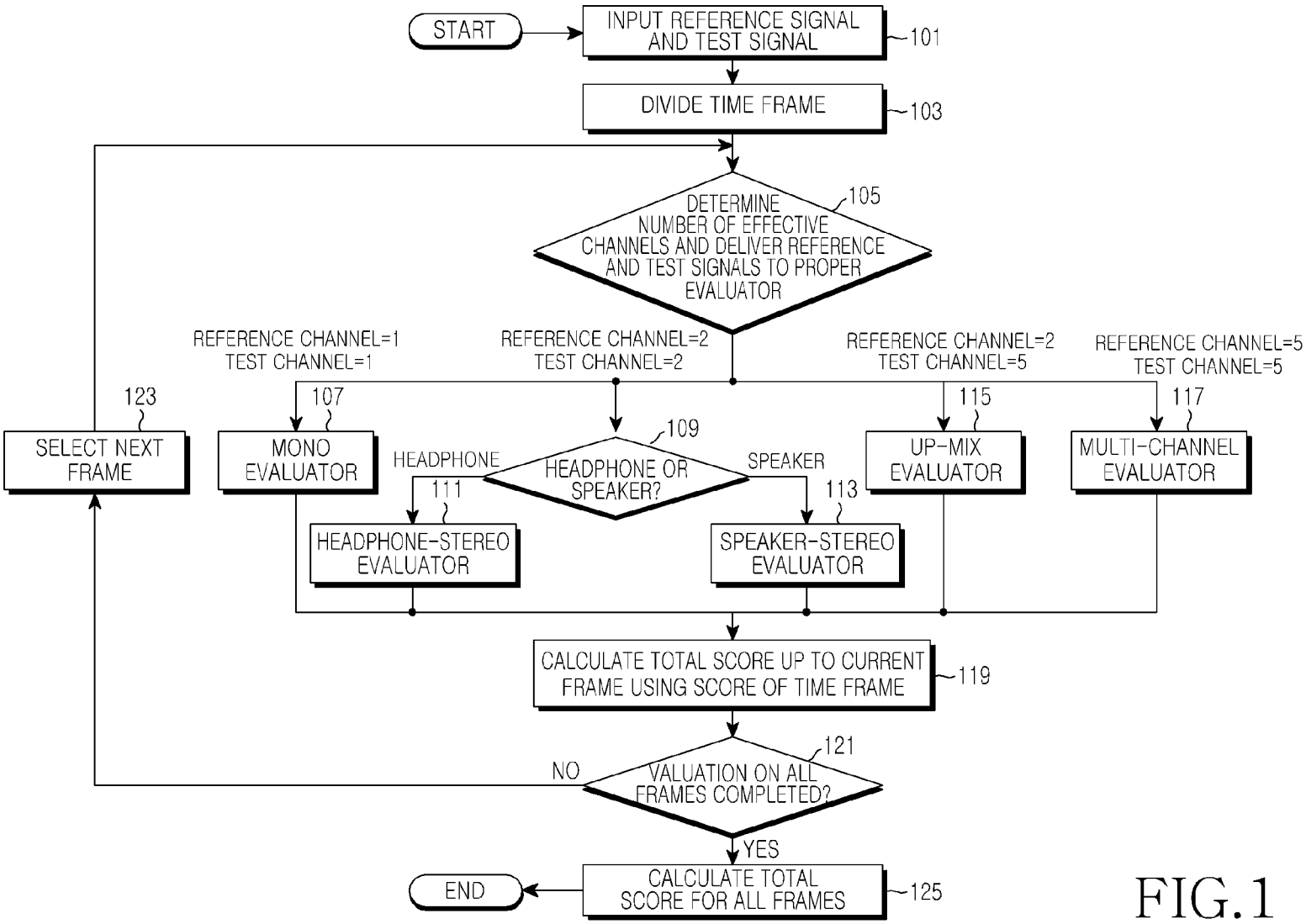
FIG. 1 is a flowchart showing an audio quality evaluation method according to an embodiment of the present general inventive concept.

The following description with reference to the accompanying drawings is provided to assistance in a comprehensive understanding of exemplary embodiments of the inventive concept as defined by the claims and their equivalents. The following description includes various specific details to assist in that understanding, but these detailed descriptions are to be regarded as merely exemplary, and not limiting of the scope and content of the overall general inventive concept. Accordingly, those of ordinary skill in the art will recognize that various changes and modifications of the embodiments described herein can be made without departing from the scope and spirit of the inventive concept. In addition, descriptions of well-known functions and constructions are omitted for clarity and conciseness.

According to embodiments of the present inventive concept, even when the user does not previously know the number of channels of an audio signal, it is possible to automatically determine the number of channels of the audio signal, select an audio quality evaluator most suitable for the determined number of audio channels, and perform audio quality evaluation using the selected audio quality evaluator. In addition, an audio quality evaluation scheme may vary according to whether an audio listening environment is listening to the audio signal directly through a speaker, or listening to the audio signal using a headphone. The present general inventive concept uses a method of dividing the entire audio signal on a frame basis, and evaluating a quality of the entire audio signal based on separate evaluation results.

The present general inventive concept can perform audio quality evaluation based on a total score scheme. The total score scheme refers to a scheme of calculating the total score for all evaluation items instead of separately evaluating several evaluation items for evaluating an audio quality. Commonly, the total score is called a Basic Audio Quality (BAQ). For reference, an important performance indicator of an audio quality evaluation system for an audio signal indicates a correlation between a BAQ during evaluation by the audio quality evaluation system and a BAQ during direct evaluation by people's ears.

In the following description of the present general inventive concept, a multi-channel signal is assumed as a 5.1-channel signal, for convenience. The multi-channel signal refers to an audio signal having more channels than the stereo signal, i.e., having three or more channels. For reference, the 5.1-channel signal includes a left front channel (first channel), a right front channel (second channel), a center channel (third channel), a low-frequency effect channel (fourth channel), a left surround channel (fifth channel), and a right surround channel (sixth channel). Even for a multi-channel signal other than the 5.1-channel signal, for example, for a 7.1-channel signal, the present general inventive concept may be implemented by those skilled in the art with a proper modification.

FIG. 1 shows an audio quality evaluation method according to an embodiment of the present general inventive concept.

In operation 101, a reference signal and a test signal are input to perform an audio quality evaluation. The reference signal refers to a source signal before being input to an audio codec, while the test signal refers to a signal obtained after the reference signal is input to the audio codec in which it undergoes coding and decoding, and this signal is subject to audio quality evaluation.

In operation 103, the input signals (reference signal and test signal) are divided in units of frames of a predetermined time period. While a time period of one frame is subject to change according to system settings, it is preferable to set the time period to a value between 1 and 10 seconds.

In operation 105, the number of effective channels for the current frame is determined, and the reference signal and the test signal are input to an appropriate audio quality evaluator depending on the determined number of effective channels.

The number of effective channels may be determined in the following manner.

First, the number of channels may be determined based on additional audio information in header information of the respective reference signal and test signal. However, in the case where an audio signal is without header information, the number of channels should be determined based on a data part of the audio signal.

For example, if the audio signal is a Pulse Coded Modulation (PCM) signal, the number of channels should be determined depending on a matrix structure of the PCM signal, since the PCM signal includes no header information. For example, if a matrix structure of the respective reference signal and test signal consists of one column, this signal is a mono signal, and if the matrix structure consists of two columns, the signal is a stereo signal.

If at least one of the reference signal and the test signal is a 5.1-channel signal with a 6-column matrix structure, it is determined whether the third, fourth, fifth and sixth channels except for the first and second channels are effective channels.

The term "effective channel" as used herein refers to a channel having an energy level greater than a specific level in the frame. In order to determine whether a certain channel is an effective channel, a percentage or ratio of the frame, which corresponds to a silent period, is determined through signal analysis, and the channel is determined as a non-effective channel if the silent period is greater than or equal to a predetermined percentage (e.g., 90%). As to determining whether a certain period is a silent period, the frame is divided on a 30-ms time basis, and the period may be determined as a silent period if a Root Mean Square (RMS) value of a sound pressure is less than −60 dB for this time through signal analysis for a 30-ms time divided from the frame.

The RMS value of a sound pressure is calculated by the following equation:

$$\text{RMS value [dB]} = 20\log_{10}\sqrt{\frac{\sum_{N} x[n]^2}{N}} \qquad \text{Equation (1)}$$

where x[n] denotes a time-domain signal of the channel and N denotes the number of periods (samples) of the x[n].

For reference, in Equation (1), x[n] is commonly expressed as values between −1 and 1, based on which an upper limit of the RMS value of a sound pressure is 0, and commonly has a negative value (−).

In the present general inventive concept, if a channel satisfies both conditions (1) and (2) below, the channel is determined as a non-effective channel. However, these conditions may be differently set according to systems.

In condition (1), more than 90% of the frame is a silent period. In condition (2), an average of RMS values of the frame should be −60 dB or less.

Even for a 5.1-channel signal with 6 channels, if other channels (third to sixth channels) except for the first and second channels are determined as non-effective channels by the effective channel determination, the signal is determined as a stereo signal.

Audio quality evaluation is performed by a proper audio quality evaluator selected depending on the determined number of effective channels.

That is, if a signal of the current frame is determined as a mono signal, audio quality evaluation is performed by a mono evaluator in operation 107. If the input signal is a stereo signal, it is determined in operation 109 whether a listening environment for the stereo signal is a headphone or a speaker. In case of the listening environment being a headphone, audio quality evaluation is performed by a headphone-stereo evaluator in operation 111, and in case of the listening environment being a speaker, audio quality evaluation is performed by a speaker-stereo evaluator in operation 113. In operation 109, an evaluator may be selected by the user on a default basis, or a message may be displayed for the user and then the user may select an evaluator in reply to the displayed message.

If at least one of the reference signal and the test signal corresponds to a 5.1-channel signal and based on the effective channel determination, the number of channels of the reference signal is less than the number of channels of the test signal, for example, if the number of channels of the reference signal is 2 and the number of channels of the test signal is 5, audio quality evaluation is performed by an UP-mix evaluator in operation 115. However, in case of a 5.1-channel signal in which the number of channels of the reference signal is equal to the number of channels of the test signal, audio quality evaluation is performed by a multi-channel evaluator in operation 117.

In operation 119, the total score of up to the current frame is calculated using the score of the frame, which is evaluated in any one of operations 107 to 117. That is, the total score of up to the current frame is calculated by adding up sums of audio quality evaluation scores of up to the previous frame and the audio quality evaluation score of the current frame, and averaging the result. A specific weight may be added to scores of the frame periods.

In operation 121, it is determined whether audio quality evaluation has been completed for all frames. If audio quality evaluation has been determined in operation 121 to not be completed for all frames; the next frame is selected in operation 123 and then operations 105 to 119 are repeated on the next frame. However, if the audio quality evaluation has been determined to be completed for all frames, the total score for all frames is finally calculated in operation 125.

The reason for calculating the total score of all frames by adding up the scores of all frames is as follows. For example, in a case of a 5.1-channel signal, a specific sound effect may exist only in a specific frame, and may not exist in other time frames. Therefore, signals of other time frames except for the frame in which the specific sound effect exists may represent the features of the stereo signal.

Embodiments of the present general inventive concept may divide all frames into time frames, calculate individual scores of the time frames, and set different frame evaluation schemes according to the system features. For example, since the total score of all frames may vary depending on a weight added to the score of a particular frame, it is possible to appropriately adjust the evaluation scheme according to signal or system features. The total score for the entire time may be calculated by the following equation:

$$R_{Total} = \frac{\sum_{M} s[k] \cdot x[k]}{\sum_{M} s[k]} \quad \text{Equation (2)}$$

where $R_{Total}$ denotes an average score of total scores for the entire time, x[k] denotes the total score of a k-th time period, M denotes the number of time periods, and s[k] denotes a saliency of a k-th time period.

If the saliency, or weight, is added to the frame, a saliency of the time period may be reflected in the total score. A saliency value may be determined in several different manners, and the present embodiment sets a loudness of a reference signal of the time frame as s[k]. The loudness may be calculated as defined in the International Standard Organization (ISO) standard, and a detailed description thereof is omitted herein.

The operations of the audio quality evaluators mentioned in operations 107 to 117 of FIG. 1 will be described in detail below.

(1) Headphone-Stereo Evaluator

Providing a brief description of a headphone-stereo evaluator, the headphone-stereo evaluator includes a Peripheral Ear Model (PEM) block, a cognition model block, and a regression model block. Model Output Variable (MOV) factors used for audio quality evaluation are extracted by the PEM block and the cognition model block, and a single total score or BAQ is made by combining those factors.

The concept of the evaluation scheme used in the headphone-stereo evaluator is as follows. As to a stereo signal, its two channels have a left signal and a right signal, respectively. Thus, this evaluation scheme groups the left signals and the right signals independently, calculates scores of the left signal group and the right signal group, and mathematically averages the scores for the left signals and the scores for the right signals. A detailed description will be made with reference to FIG. 2.

Figure 2:
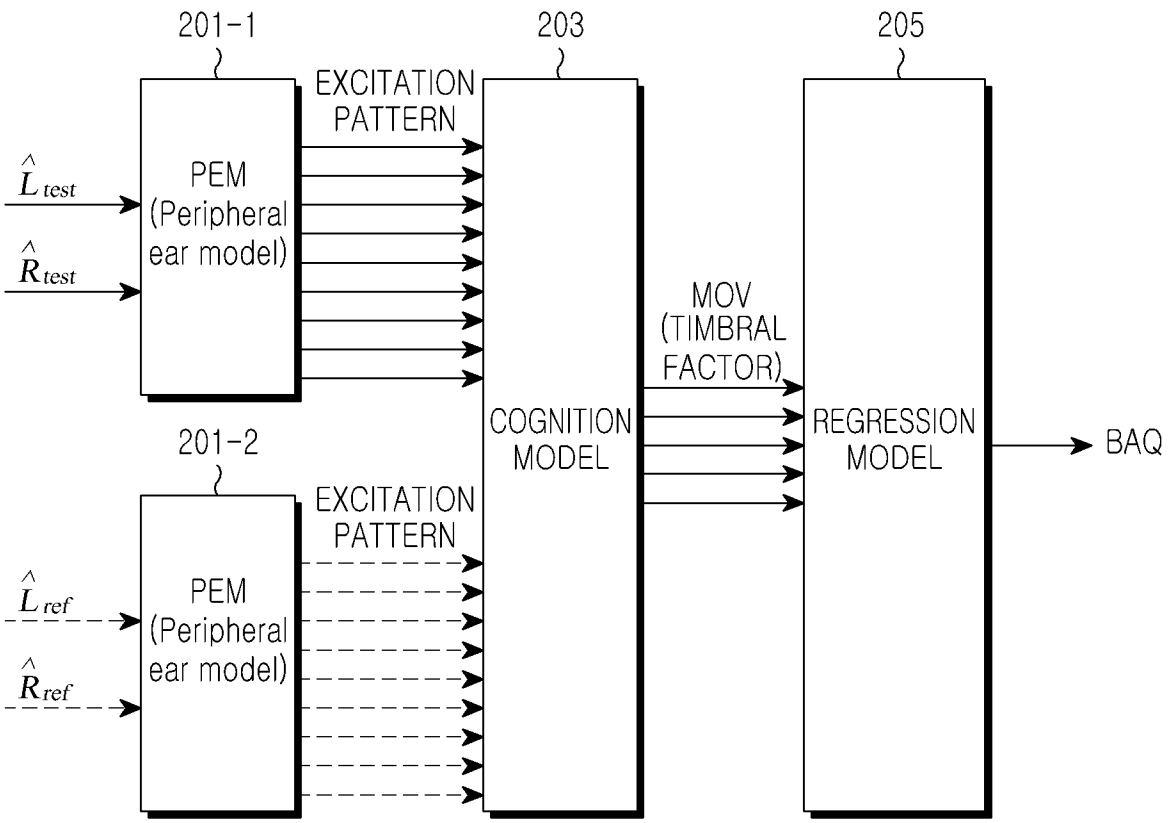
FIG. 2 is a block diagram of a headphone-stereo evaluator used in an embodiment of the present general inventive concept.

FIG. 2 shows a structure of the headphone-stereo evaluator used in an embodiment of the present general inventive concept.

A test signal and a reference signal are input to PEMs 201-1 and 201-2, respectively. The PEMs 201-1 and 201-2 are functional blocks copying a process in which a music signal or vibration of the air being input to people's ears is converted into an electrochemical signal that excites the auditory nerves, passing through the external ear, the middle ear and the internal ear, and outputs of the PEMs 201-1 and 201-2 are called "excitation patterns." The excitation patterns output from the PEMs 201-1 and 201-2 are input to a cognition model block 203.

The cognition model block 203 is a functional block that extracts evaluation factors from the input excitation patterns by performing a predetermined operation. That is, the excitation patterns input to the cognition model block 203 include the excitation patterns for the left signal and the excitation patterns for the right signal, which are grouped independently, and the cognition model block 203 extracts evaluation factors from the pattern groups by cognition modeling. The extracted evaluation factors are called "Model Output Variables (MOVs)."

The MOVs are values defined by representing in number the audio quality degradation factors the user experiences, such as the noise level and the distortion of sound balance, and one MOV indicates one audio quality factor. The cognition model block 203 extracts the MOV values and then inputs them to a regression model block 205. The regression model block 205 calculates a total score or BAQ by combining the input MOVs in many different manners. For reference, a modeling scheme called a neural network is used for the regression model block in ITU-R BS.1387-1.

(2) Mono Evaluator

The mono evaluator is different from the headphone-stereo evaluator described in FIG. 2 in that it has only one PEM. That is, a reference signal and a test signal are input to one PEM to perform audio quality evaluation since a mono signal has only one channel.

(3) Multi-Channel (5.1-Channel) Evaluator

Figure 3:
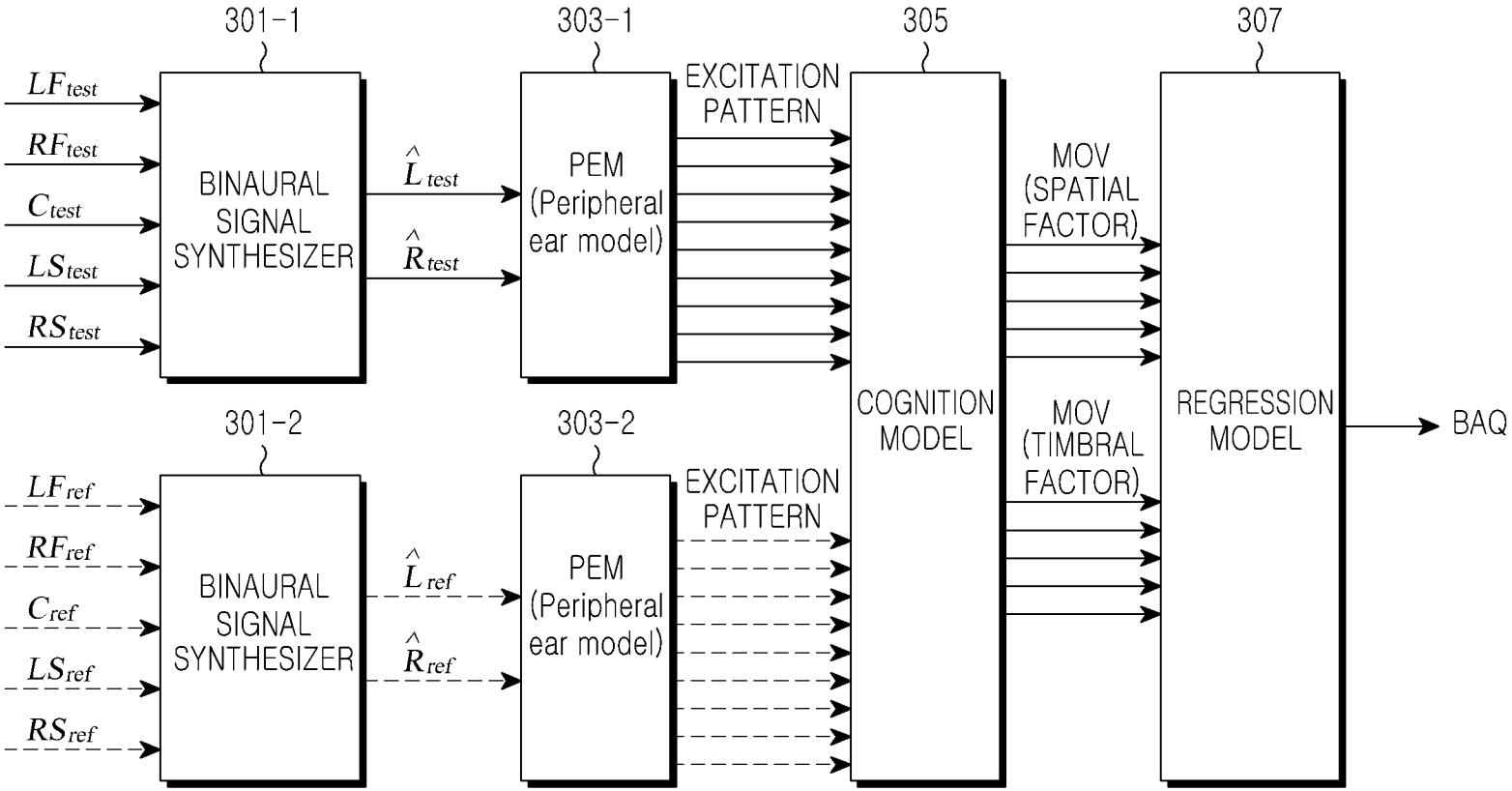
FIG. 3 is a block diagram of a multi-channel evaluator used in an embodiment of the present general inventive concept.

FIG. 3 shows a structure of the multi-channel evaluator used in an embodiment of the present general inventive concept.

Test signals and reference signals of respective channels constituting a 5.1-channel signal are input to binaural signal synthesizers 301-1 and 301-2. The binaural signal synthesizers 301-1 and 301-2 synthesize the input test signals and reference signals, and output binaural signals. The binaural signals output from the binaural signal synthesizers 301-1 and 301-2 additionally have space perception evaluation factors, as compared with the binaural signals of the headphone-stereo evaluator of FIG. 2.

The term "space perception evaluation factors" as used herein refers to factors to evaluate a spatial position of an audio signal the listener hears. In the present embodiment, at least one of three factors may be added. Interaural Time Difference Distortion (ITDDist), Interaural Level Difference Distortion (ILDDist) and Interaural Cross Correlation Distortion (IACCDist). In multi-channel signal evaluation, since the space perception evaluation factors correspond to one of the important features to distinguish a multi-channel signal from a stereo signal, a high weight may be added to the space perception evaluation factors during BAQ calculation.

Functional blocks arranged after the binaural signal synthesizers 301-1 and 301-2 are equal in structure to those of the headphone-stereo evaluator described in FIG. 2. That is, PEMs 303-1 and 303-2, a cognition model block 305, and a regression model block 307 are added. However, there is a difference in that the cognition model block 305 additionally measures the three space perception evaluation factors. A method of measuring these factors is disclosed in a reference document "Choi, IY, B G Shinn-Cunningham, S B Chon, and K-M Sung (2008), "Objective Measurement of Perceived Auditory Quality in Multi-channel Audio Compression Coding Systems," Journal of the, Audio Engineering Society, 56, 3-17."

In addition, since the regression model block 307 should use a regression scheme including the added three factors, the structure of a neural network of the regression model block 307 to output a BAQ should also be changed.

(4) Speaker-Stereo Evaluator

Figure 4:
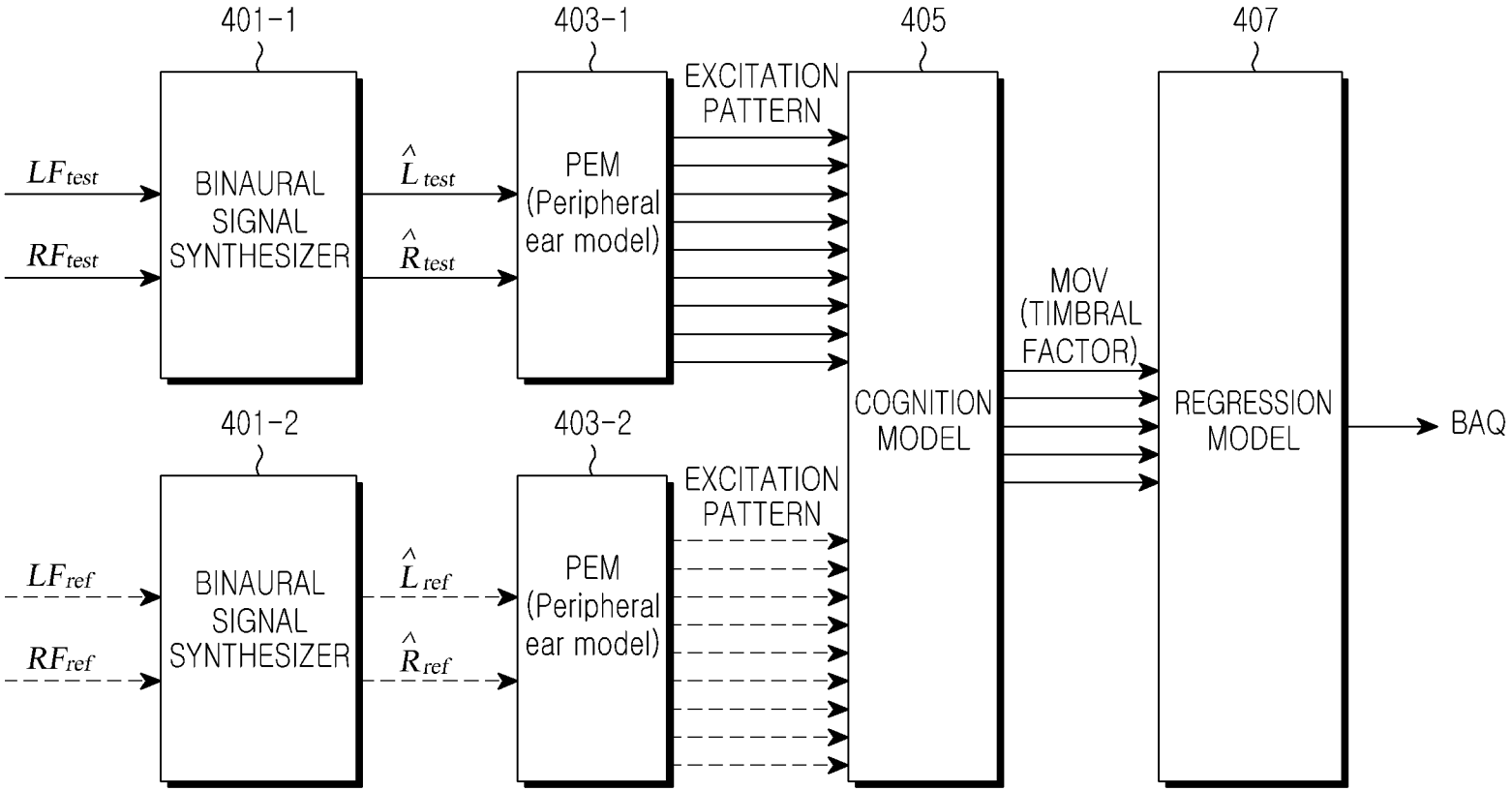
FIG. 4 is a block diagram of a speaker-stereo evaluator used in an embodiment of the present general inventive concept.

FIG. 4 shows a structure of the speaker-stereo evaluator used in an embodiment of the present general inventive concept.

The speaker-stereo evaluator is similar to the multi-channel evaluator of FIG. 3 in basic structure. However, there is a difference in that a test signal and a reference signal being input to binaural signal synthesizers 401-1 and 401-2 are originated from two channels since the input signal is a stereo signal.

In addition, there is a difference in that a weight of the speaker-stereo evaluator is different from the weight for the three space perception evaluation factors described in FIG. 3 and an internal structure of a regression model block 407 is changed to calculate a BAQ considering the changed weight. That is, the overall structure is equal to that of the multi-channel evaluator in FIG. 3, but the internal structures of the binaural signal synthesizers 401-1 and 401-2 and the regression model block 407 are different from those of the multi-channel evaluator.

(5) UP-Mix Evaluator

Figure 5:
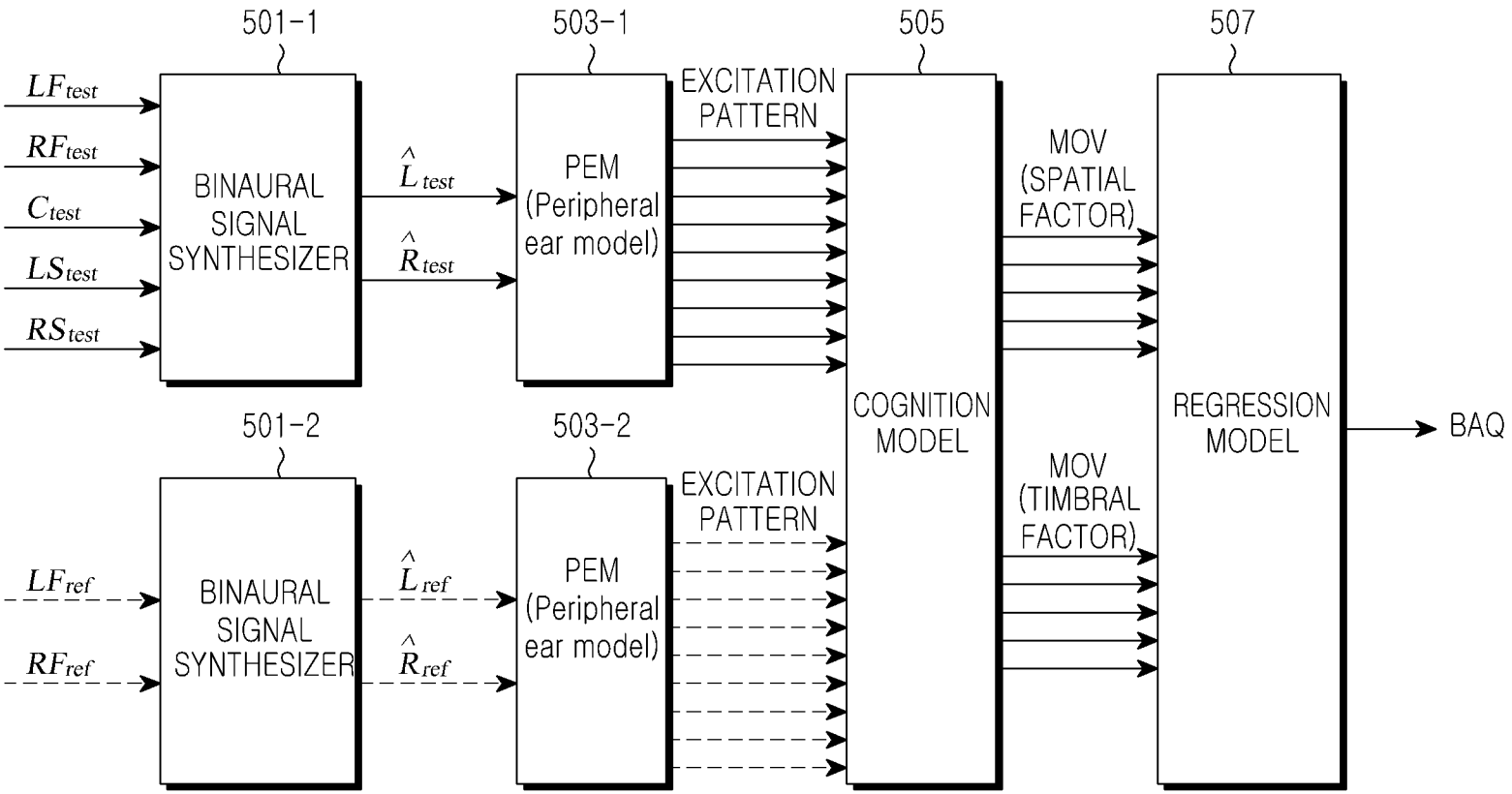
FIG. 5 is a block diagram of an UP-mix evaluator used in an embodiment of the present general inventive concept.

FIG. 5 shows a structure of the UP-mix evaluator used in an embodiment of the present general inventive concept.

The basic structure is similar to that of the multi-channel evaluator in FIG. 3 except that, assuming that the number of channels of a reference signal is 2 and the number of channels of a test signal is 5, the number of reference signals and test signals being input to binaural signal synthesizers 501-1 and 501-2 is different from that in FIG. 3.

Moreover, a weight of the UP-mix evaluator is different from the weight for the space perception evaluation factors described in FIG. 3 and an internal structure of a regression model block 507 is changed to calculate a BAQ considering the changed weight. That is, the overall structure is equal to that of the multi-channel evaluator in FIG. 3, but the internal structures of the binaural signal synthesizers 501-1 and 501-2 and the regression model block 507 are different from those of the multi-channel evaluator.

Figure 6:
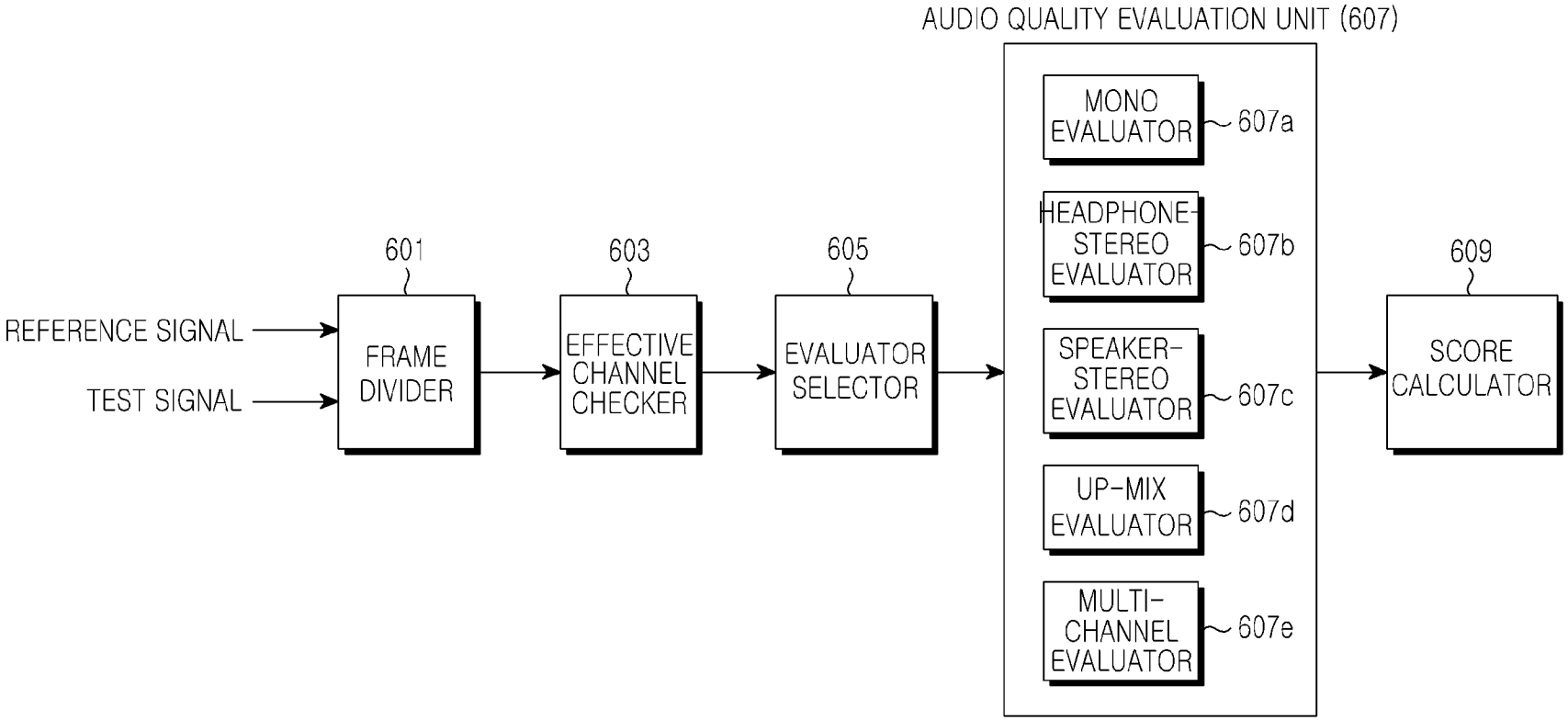
FIG. 6 is a block diagram of an audio quality evaluation apparatus according to an embodiment of the present general inventive concept.

FIG. 6 shows a structure of an audio quality evaluation apparatus according to an embodiment of the present general inventive concept.

A frame divider 601 receives a test signal and a reference signal, and divides them into frames of a predetermined time period. An effective channel checker 603 checks effective channels of the input signals and outputs the results to an evaluator selector 605. A method of checking whether a certain channel is an effective channel has been described in FIG. 1. The evaluator selector 605 inputs a select signal to an appropriate evaluator in an audio quality evaluation unit 607 based on the effective channel check results, i.e., the number of effective channels of the reference signal and the test signal. However, in the case of a stereo signal, a message may be displayed on a display device (not shown) to inquire of the user which evaluator will be selected depending on the listening environment of the user, and then an evaluator may by selected by the user. The audio quality evaluation unit 607 includes a mono evaluator 607*a*, a headphone-stereo evaluator 607*b*, a speaker-stereo evaluator 607*c*, an UP-mix evaluator 607*d* and a multi-channel evaluator 607*e*, to evaluate qualities of an audio signal received from the evaluator selector 605 according to the signal type. Operations of the respective evaluators have been described in detail in FIG. 1. A score calculator 609 calculates the total score of audio quality for the entire time through a predetermined operation using an audio quality evaluation score in the current frame and an audio quality evaluation score of up to the previous frame, which are based on the evaluation results by the audio quality evaluation unit 607. In this calculation, a weight may be added to each frame.

Effects of the present general inventive concept audio quality evaluation method and apparatus will be described with reference to FIGS. 7 and 8.

Figure 7:
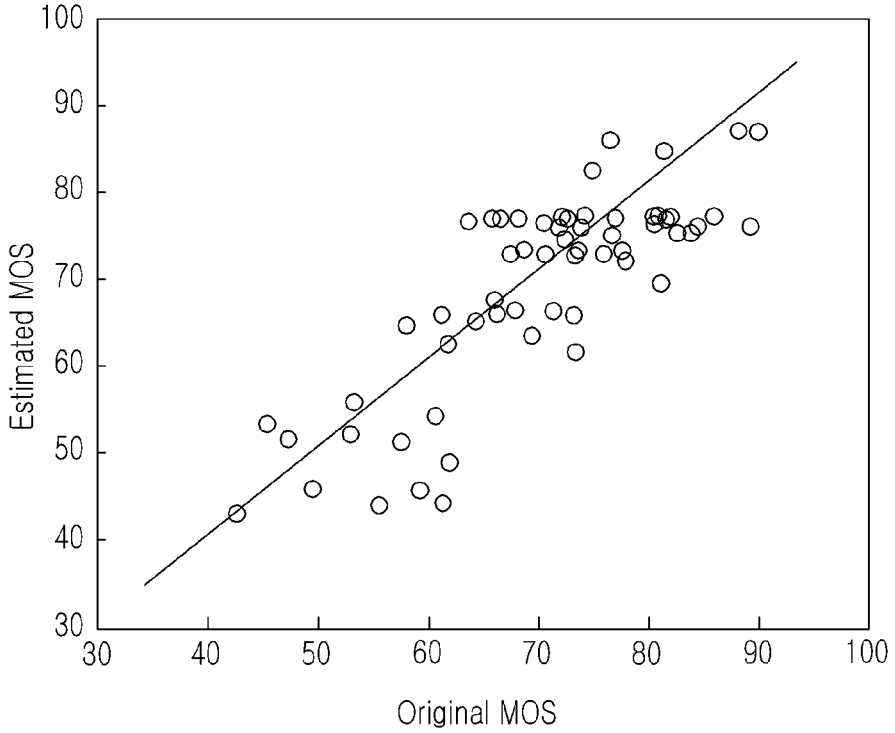
FIG. 7 is a diagram showing a correlation between an evaluation score and a listening evaluation of a multi-channel signal according to the conventional audio quality evaluation method.
Figure 8:
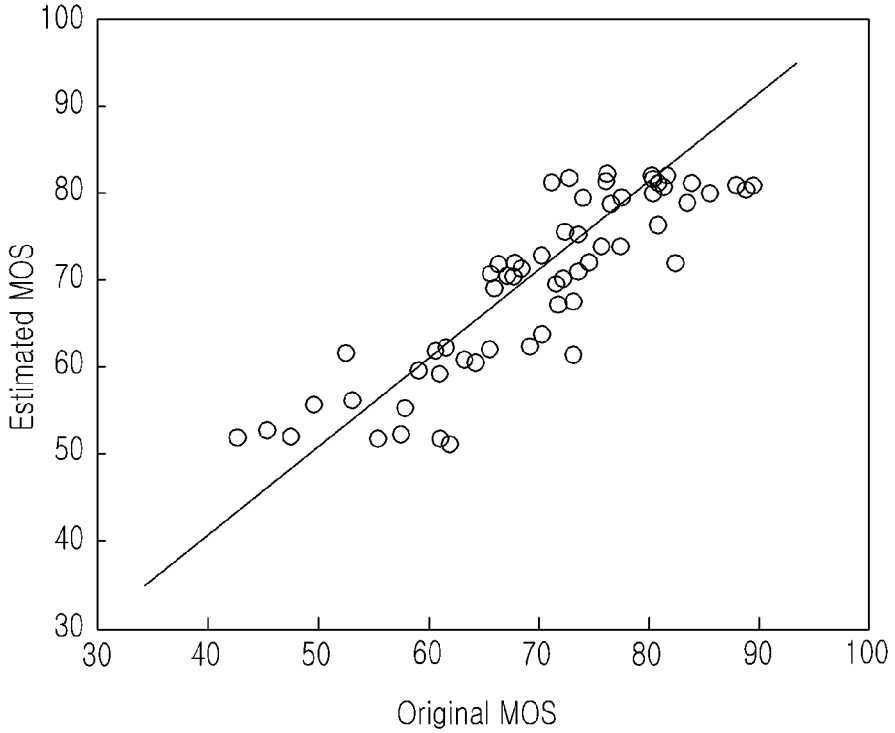
FIG. 8 is a diagram showing a correlation between an evaluation score and a listening evaluation of a multi-channel signal according to an audio quality evaluation method of exemplary embodiments of the present general inventive concept.

FIG. 7 shows a correlation between an evaluation score and a listening evaluation of a multi-channel signal according to the conventional audio quality evaluation method, and FIG. 8 shows a correlation between an evaluation score and a listening evaluation of a multi-channel signal according to an audio quality evaluation method of exemplary embodiments herein.

In FIG. 7, the x-axis represents a listening evaluation score based on the actual listening result by users, and the y-axis indicates an evaluation score by the conventional audio quality evaluation method. A correlation coefficient between both scores is 0.82. In FIG. 8, the x-axis represents a listening evaluation score and the y-axis represents an evaluation score by exemplary embodiments of the present general inventive concept. A correlation coefficient between both scores is 0.88. Analyzing the results, it can be understood that in the case of a multi-channel signal, the correlation of the proposed audio quality evaluation scheme is higher by about 7.4% than the correlation of the conventional audio quality evaluation scheme.

As is apparent from the foregoing description, exemplary embodiments of the present general inventive concept may improve audio quality evaluation performance by selecting an optimal audio quality evaluator according to a type of an audio signal, i.e., the number of channels included in the audio signal. In addition, while the evaluation scheme for a stereo signal is used in the conventional evaluation for a multi-channel audio signal, the present exemplary embodiments may remarkably improve evaluation accuracy during performance evaluation for a multi-channel signal by adding important evaluation factors for multi-channel evaluation. Furthermore, the exemplary embodiments of the present general inventive concept may increase a flexibility of audio quality evaluation by dividing the entire audio signal on a frame basis and performing audio quality evaluation thereon.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

While the present general inventive concept has been shown and described with reference to certain exemplary embodiments thereof, it will be understood by those skilled in the art that various changes in form and details may be made therein without departing from the spirit and scope of the general inventive concept as defined by the appended claims and their equivalents.

What is claimed is:

1. A method for evaluating a quality of an audio signal, comprising:

determining a number of effective channels for each of a reference signal of a current frame and a test signal obtained by encoding or decoding the reference signal through an audio codec, the effective channels having an energy level greater than a specific level in a corresponding frame;

selecting an audio quality evaluator corresponding to the determined number of effective channels among a plurality of audio quality evaluators; and evaluating an audio quality of the current frame by using the selected audio quality evaluator wherein an audio quality evaluator is selected from the plurality of audio quality evaluators if the determined number of effective channels for each of the reference signal and the test signal are different from each other.

2. The method of claim 1, further comprising:

adding a predetermined weight to an audio quality evaluation score calculated by evaluating the audio quality of the current frame; andd calculating an audio quality evaluation score of up to the current frame through a predetermined operation based on the weight-added audio quality evaluation score of the current frame and an audio quality evaluation score of up to a previous frame.

3. The method of claim 1, wherein the determining the number of effective channels comprises dividing the current frame into time periods of a predetermined length, determining a time period having an energy less than a threshold among the time periods as a silent period, and determining the determined time period as an effective channel of the current frame if the time period determined as a silent period is less than a predetermined ratio of all time periods.

4. The method of claim 1, wherein the evaluating an audio quality of the current frame comprises:

evaluating the audio quality of the current frame by using a multi-channel evaluator with regard to a multi-channel signal in which the reference signal and the test signal are equal in the number of effective channels;

wherein the multi-channel evaluator evaluates the audio quality of the current frame based on at least one of an Interaural Time Difference Distortion (ITDDist) factor, an Interaural Level Difference Distortion (ILDDist) factor, and an Interaural Cross Correlation Distortion (IACCDist) factor.

5. The method of claim 1, wherein the evaluating an audio quality of the current frame comprises:

evaluating an audio quality of a stereo signal, in which the number of effective channels for each of the reference signal and the test signal is two, using a speaker-stereo evaluator if a listening environment is a speaker; and evaluating an audio quality of the stereo signal using a headphone-stereo evaluator if a listening environment is a headphone.

6. An apparatus to evaluate a quality of an audio signal, comprising:

an effective channel checker to determine a number of effective channels for each of a reference signal of a current frame and a test signal obtained by encoding or decoding the reference signal through an audio codec, the effective channels having an energy level greater than a specific level in a corresponding frame;

an evaluator selector to select an audio quality evaluator corresponding to the determined number of effective channels among a plurality of audio quality evaluators; and an audio quality evaluation unit to evaluate an audio quality of the current frame by using the selected audio quality evaluator, wherein an audio quality evaluator is selected from the plurality of audio quality evaluators if the determined number of effective channels for each of the reference signal and the test signal are different from each other.

7. The apparatus of claim 6, further comprising:

a score calculator to add a predetermined weight to at audio quality evaluation score calculated by evaluating the audio quality of the current frame, and to calculate an audio quality evaluation score of up to the current frame through a predetermined operation based on the weight-added audio quality evaluation score of the current frame and an audio quality evaluation score of up to a previous frame.

8. The apparatus of claim 6, wherein the effective channel checker divides the current frame into time periods of a predetermined length, determines a time period having an energy less than a threshold among the time periods as a silent period, and determines the determined time period as an effective channel of the current frame if the time period determined as a silent period is less than a predetermined ratio of all time periods.

9. The apparatus of claim 6, wherein the audio quality evaluation unit evaluator comprises:

a multi-channel evaluator to evaluate an audio quality of the current frame with regard to a multi-channel signal in which the reference signal and the test signal are equal in the number of effective channels;

wherein the multi-channel evaluator evaluates an audio quality of the current frame based on at least one of an Interaural Time Difference Distortion (ITDDist) factor, an Interaural Level Difference Distortion (ILDDist) factor, and an Interaural Cross Correlation Distortion (IACCDist) factor.

10. The apparatus of claim 6, wherein the audio quality evaluation unit comprises:

a speaker-stereo evaluator to evaluate an audio quality of the current frame with regard to a stereo signal, in which the number of effective channels for each of the reference signal and the test signal is two, if a listening environment is a speaker; and a headphone-stereo evaluator to evaluate an audio quality of the current frame if a listening environment is a headphone.

11. A method of evaluating a quality of an audio signal, comprising:

dividing a reference signal and a test signal of an input audio signal into frames of a predetermined time period;

determining a number of effective channels for each of the reference signal of the current frame and the test signal obtained by encoding or decoding the reference signal through an audio codec, the effective channels having an energy level greater than an specific level in a corresponding frame;

selecting an audio quality evaluator corresponding to the determined number of effective channels among a plurality of audio quality evaluators;

evaluating an audio quality of the current frame by using the selected audio quality evaluator; and calculating a total audio quality evaluation score of the divided frames, wherein an audio quality evaluator is selected from the plurality of audio quality evaluators if the determined number of effective channels for each of the reference signal and the test signal are different from each other.

12. The method of claim 11, wherein the calculating a total audio quality evaluation score of all frames includes calculating individual scores of the time frames, and setting different frame evaluation schemes depending on a weight added to a frame.

13. An audio signal quality determination apparatus, comprising:

a frame divider to divide a test signal and a reference signal of an input audio signal into frame of a predetermined time period;

an effective channel checking device to determine a number of effective channels for each of the reference signal of a current frame and the test signal obtained by encoding or decoding the reference signal through an audio codec and to select an audio quality evaluator corresponding to the determined number of effective channels among a plurality of audio quality evaluators, the effective channels having an energy level greater than a specific level in a corresponding frame;

an audio quality evaluation unit to evaluate an audio quality of the current frame by using the selected audio quality evaluator, wherein an audio quality evaluator is selected from the plurality of audio quality evaluators if the determined number of effective channels for each of the reference signal and the test signal are different from each other.

14. The apparatus of claim 13, wherein the audio quality evaluation unit comprises at least one of a mono evaluator, a headphone-stereo evaluator, a speaker-stereo evaluator, an UP-mix evaluator and a multi-channel evaluator.

15. The apparatus of claim 14, further comprising:

a score calculator to calculate a total score of an audio quality for an entire time through a predetermined operation using an audio quality evaluation score in the current frame and an audio quality evaluation score of up to a previous frame, which are based on evaluation results by the audio quality evaluation unit.

16. A non-transitory computer readable recording medium containing codes thereon which perform the following operations:

determining a number of effective channels for each of a reference signal of a current frame and a test signal obtained by encoding or decoding the reference signal through an audio codec, the effective channels having an energy level greater than a specific level in a corresponding frame;

selecting an audio quality evaluator corresponding to the determined number of effective channels among a plurality of audio quality evaluators; and evaluating an audio quality of the current frame by using the selected audio quality evaluator, wherein an audio quality evaluator is selected from the plurality of audio quality evaluators if the determined number of effective channels for each of the reference signal and the test signal are different from each other.

17. A non-transitory computer readable recording medium containing codes thereon which perform the following operations:

dividing a reference signal and a test signal of an input audio signal into frames of a predetermined time period;

determining a number of effective channels for each of the reference signal of a current frame and the test signal obtained by encoding or decoding the reference signal through an audio codec, the effective channels having an energy level greater than a specific level in a corresponding frame;

selecting an audio quality evaluator corresponding to the determined number of effective channels among a plurality of audio quality evaluators;

evaluating an audio quality of the current frame by using the selected audio quality evaluator; and calculating a total audio quality evaluation score of the divided frames, wherein an audio quality evaluator is selected from the plurality of audio quality evaluators if the determined number of effective channels for each of the reference signal and the test signal are different from each other.

* * * * *

UNITED STATES PATENT AND TRADEMARK OFFICE

CERTIFICATE OF CORRECTION

PATENT NO. : 8,879,762 B2
APPLICATION NO. : 12/695252
DATED : November 4, 2014
INVENTOR(S) : In-yong Choi It is certified that error appears in the above-identified patent and that said Letters Patent is hereby corrected as shown below:

In the Claims

Claim 1, Column 11, Line 5:

Delete “evaluator” and insert --evaluator,--, therefor.

Claim 2, Column 11, Line 13:

Delete “frame; andd” and insert --frame; and--, therefor.

Claim 7, Column 12, Line 2:

delete “at audio” and insert --an audio--, therefor.

Claim 9, Column 12, Line 19:

Delete “unit evaluator” and insert --unit--, therefor.

Signed and Sealed this
Fifteenth Day of September, 2015

Michelle K. Lee

Michelle K. Lee
*Director of the United States Patent and Trademark Office*